United States Patent [19]

Zemels

[11] 3,998,520

[45] Dec. 21, 1976

[54] ELECTRIC ELBOW CONNECTOR

[75] Inventor: Carl G. Zemels, Lilburn, Ga.

[73] Assignee: Kearney-National Inc., Atlanta, Ga.

[22] Filed: Nov. 13, 1975

[21] Appl. No.: 631,717

[52] U.S. Cl. ..... 339/276 T; 339/278 C

[51] Int. Cl.[2] ..... H01R 3/02

[58] Field of Search ..... 339/59–61, 339/111, 276–278, 263; 174/73 R; 29/180 CH; 148/11.5 A, 39, 145

[56] References Cited

UNITED STATES PATENTS

| | | | |
|---|---|---|---|
| 2,371,469 | 3/1945 | Rogoff | 339/276 T |
| 2,810,864 | 10/1957 | Inenour | 339/111 |
| 2,978,667 | 4/1961 | Watts | 339/276 T |
| 3,233,211 | 2/1966 | Smith | 339/276 T |
| 3,711,818 | 1/1973 | Swehla | 339/60 C |
| 3,768,065 | 10/1973 | Zemels | 339/111 |

*Primary Examiner*—Joseph H. McGlynn
*Attorney, Agent, or Firm*—Walter M. Rodgers; Walter A. Rodgers

[57] ABSTRACT

An electric elbow connector comprises an L-shaped hollow housing structure formed of insulating material and of semi-conducting material which contains an elongated contact sleeve having a hollow sleeve portion at one end and an integral shank at the other end, the shank having an outer end portion of substantially larger transverse dimension than its inner portion and the outer portion of the shank being of a hardness considerably greater than the hardness of the inner portion of the shank and of the hollow end portion of the contact sleeve, and a contact pin in electric contact with the hard outer end portion of the shank of the contact sleeve and disposed within the housing.

12 Claims, 4 Drawing Figures

ELECTRIC ELBOW CONNECTOR

Electric connectors such as that disclosed in U.S. Pat. No. 3,768,065 issued Oct. 23, 1973 incorporate a contact sleeve one end of which includes a hollow sleeve portion for receiving an end of an electric conductor about which the sleeve portion is crimped or mechanically clamped by suitable gripping means. In order to insure that a proper gripping action may be effected, the sleeve portion of the contact sleeve must be sufficiently soft in order to render the sleeve readily deformable and thereby to insure a secure electric contact between the contact sleeve and the conductor therein.

It has been customary to form the shank portion of a contact sleeve of the same material as that used to form the soft sleeve portion of the contact sleeve. Since the associated contact pin is either threaded into the shank of the contact sleeve or arranged with its end held in secure firm contact with the exterior surface of the shank, considerable difficulty has developed due to the fact that installers do not impart a precisely accurate force when connecting the contact pin of the connector with the terminal of electric apparatus such as a transformer. When a force is applied which is not aligned with the contact pin, an unbalanced sidewise force is imparted which tends to deform the L-shaped soft yieldable housing structure and also tends to shift the angular relationship between the contact pin and the shank end of the contact sleeve. Such shifting of position tends to reduce the contact pressure by excessively deforming and gouging the shank of the contact sleeve. A substantially deformed shank allows the associated contact pin to become loose and readily removably by simple finger pressure: Improper electric contact and undesired excessive heating usually result.

In order to overcome the aforementioned difficulty, contact sleeves have been formed of two different materials. For example, the sleeve portion may be formed of relatively soft material such as certain aluminum compositions and the shank portion may be formed of relatively hard material such as copper and welded or otherwise secured to the end of the soft sleeve portion. Obviously this procedure using two different materials is costly and unless a proper weld is formed at the junction of the two different parts, heating due to the flow of electric current becomes localized and may cause localized hot spots.

Still another approach has been taken to solve this problem and simply constitutes the use of relatively hard material for the entire contact sleeve. Of course material which is hard is difficult to crimp about an electric conductor and tends to result in a poor connection between the sleeve portion of a contact sleeve and the conductor disposed therein.

According to the present invention in one form, the shank portion of a contact sleeve is specially configured so that the outer end portion thereof is of substantially larger cross-sectional dimension than the inner portion and by this means deformation of the inner portion of the shank of the contact sleeve may be effected more readily than deformation of the outer end portion to which the contact pin is electrically connected. Thus when an off center unbalanced force is applied to the connector during connection with a transformer terminal, for example, the smaller diameter inner portion of the shank of the contact sleeve may deform particularly by bending without materially affecting the angular relationship between the contact pin and the outer end portion of the shank of the contact sleeve. In addition and in accordance with another facet of this invention, the outer larger end portion of the shank of the contact sleeve is metallurgically treated in such manner as to render that portion substantially harder and more capable of withstanding high surface pressure than the inner portion of the shank of the contact sleeve and the sleeve portion thereof. Thus when off center forces are imparted, the relatively soft smaller inner portion of the shank is more readily deformable particularly by bending than is the outer contact making harder end of the shank of the contact sleeve subject to surface deformation. Thus by this means also deformation of the surface of the outer end portion of the shank of the contact sleeve is inhibited and virtually prevented and secure and snug contact is maintained between the contact pin and the surface of the outer enlarged and hardened end portion of the shank of the contact pin. Furthermore since the sleeve portion of the contact sleeve is sufficiently soft, a secure and firm contact may be effected with the conductor disposed therein by conventional clamping or crimping operations. For some applications of the invention, it may be sufficient to form the inner portion of the shank of the contact sleeve of smaller diameter than the outer end portion of the shank and to omit the step of hardening the outer end portion of the shank. Conversely for certain applications of the invention, increasing the hardness of the outer end portion of the shank may suffice without employing the reduced diameter of the inner portion of the shank.

For a better understanding of the invention reference may be had to the following detailed description taken in conjunction with the accompanying drawings in which FIG. 1 is an overall side view of an elbow connector of a type to which the invention is applicable;

FIG. 3 is an exploded perspective view of the conducting elements formed according to this invention; and in which

Figure 1:
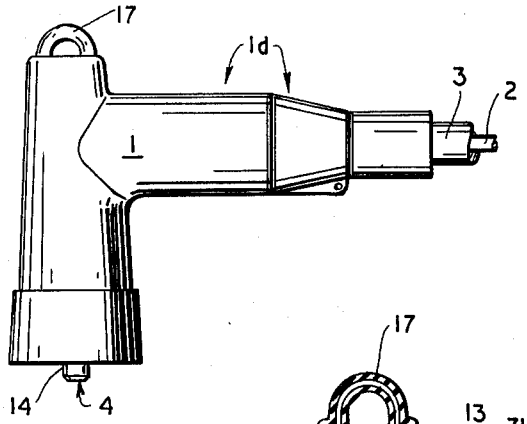

In FIG. 1 the numeral 1 generally designates the elbow housing structure which preferably is constructed of yieldable material. An elongated conductor designated by the numeral 2 enters the housing structure 1 and is surrounded by conventional insulating material 3. A contact pin 4 protrudes outwardly from the lower portion of the elbow housing 1 and, as is well known, is adapted for engaging and making electric contact with the terminal of an electric device such as a power transformer.

For the purpose of interconnecting the elongated conductor 2 with the contact pin 4, a contact sleeve 5 includes a sleeve portion **5*a* of hollow construction at its right-hand end as indicated at 6 and receives the left-hand end of conductor 2. Contact between these elements is secured and maintained by clamping action as is well known. The contact sleeve 5 is provided at its left-hand end with a shank portion 7 which is inserted within a contact making passage 8 formed within contact body 9 following insertion of contact body 9 into elbow 1. Contact making passage 8 is smooth and unthreaded and of larger diameter than shank 7** so as to accommodate relative rotation and transverse lost motion therebetween. The end B of shank 7 is bevelled to facilitate assembly.

Contact pin 4 is provided with threads 10 and with a reduced end portion 11 of smaller diameter than the threaded portion 10 thereof. The contact pin 4 is screwed into the threaded contact making passage 12 formed in contact body 9 until the end 11 of the contact pin 4 engages the outer end portion 7*a* of shank 7 of contact sleeve 5 as indicated at 13 in FIG. 2. Contact pin 4 is provided with an end portion 14 formed of non-conductive material in conventional fashion.

Figure 2:
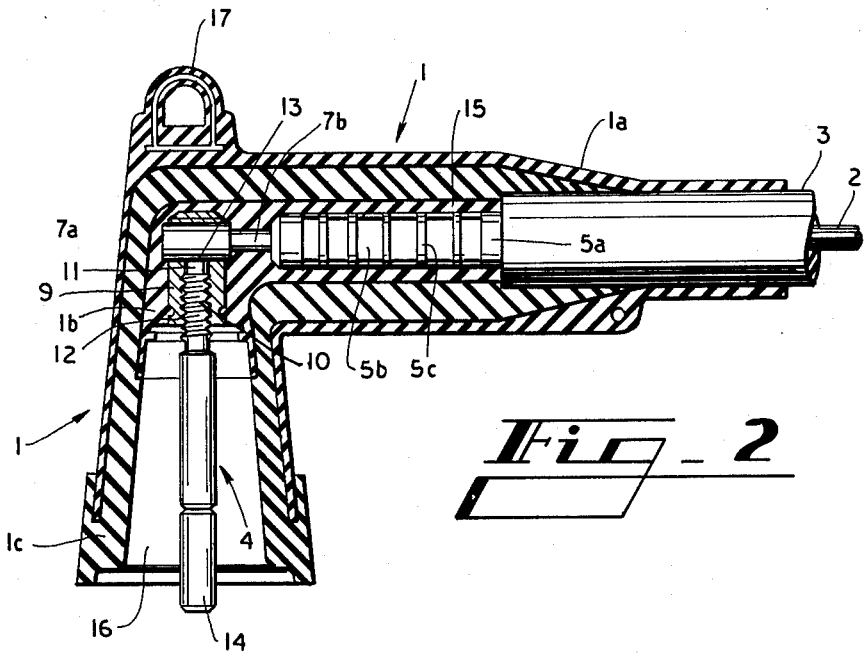
FIG. 2 is a view similar to FIG. 1 but which is shown in section so as to depict the assembled relationship of the internal parts.

The contact body 9 is disposed in fixed relation within the elbow housing 1 and occupies the position depicted in FIG. 2. Of course the contact making passage 8 is disposed in alignment with the cavity defining passage 15 formed in the elbow housing and the contact making threaded passage 12 is automatically disposed in alignment with the cavity defining passage 16 formed in the elbow housing. With the contact body mounted within the elbow housing as shown in FIG. 2, the structure is then ready for field installation.

Assembly in the field is effected by simply clamping or crimping the sleeve portion 5*a* of contact sleeve 5 onto the conductor 2 as indicated by peripheral grooves 5*b* and ridges 5*c* in FIG. 2 and the shank 7 of the contact sleeve 5 is then inserted into the contact making passage 8 simultaneously with the insertion of the contact sleeve and the associated conductor into the cavity defining passage 15 until the parts occupy the positions depicted in FIG. 2. The transverse dimensions of the exterior of contact sleeve 5 and the interior of cavity defining passage 15 are such that free relative rotation of these parts is accommodated. Thereafter the contact pin 4 is screwed into the contact making cavity 12 in such manner as to cause the tip 11 to deform evenly outer end portion 7*a* of shank 7. A pull ring 17 is mounted on housing structure 1 and, as is well known, a conventional hook stick or the like engages ring 17 for manipulating the connector contact pin 4 into and out of contact making relationship with the associated terminal of an adjacent electric apparatus such as a transformer.

The enclosing housing generally designated by the numeral 1 is formed of elastomeric material which is yieldable and includes an outer structure 1*a* of semi-conducting material which serves as an enclosing sheath together with an internal semi-conducting material designated by the numeral 1*b* which closely surrounds the conductive parts together with insulating material designated 1*c*. While the housing 1 preferably is manipulated by a hook stick arranged to cooperate with the hook 17 as explained, installers frequently simply grasp the connector in the region designated 1*d* and exert a circuit closing force to cause the contact pin to engage the terminal of an electric apparatus such as a transformer. Since the force applied at the region designated 1*d* is not in alignment with the contact pin 4, there is a tendency to reduce the angular relationship between the contact sleeve 5 and contact pin 4 by swinging the contact sleeve clockwise somewhat relative to contact pin 4. Where the contact sleeve is formed of readily deformable material suitable for crimping the conductor 2 and where the shank 7 is formed of similar soft material such as aluminum, the force applied by the operator in the region designated 1*d* tends to cause the tip 11 of the contact pin 4 to gouge into and undesirably deform the shank 7. This undesirable deformation of shank 7 results in a poor contact between the end 11 of contact pin 4 and the side wall of shank 7. Thus electric conductivity is impaired and the contact pin sometimes is so loosened that it may simply be removed without benefit of tools and by a simple finger gripping motion.

According to the present invention, the contact shank 7 is provided with an inner portion 7*b* of reduced transverse dimension whereby bending of the shank 7 as the reduced diameter portion 7*b* may be effected when a force is applied in the region 1*d*. This bending action of portion 7*b* tends to prevent gouging of end portion 7*a* and tends to retain normal high pressure contact between the end 11 of contact pin 4 and the side of end portion 7*a* of shank 7.

According to another facet of this invention, the outer end portion 7*a* is treated by known procedures in such manner as to be considerably harder than the reduced section 7*b* and the sleeve portion 5*a* of the contact sleeve. Preferably this difference in hardness is achieved by known metallurgical techniques such that the minimum hardness of the outer end portion 7*a* of the shank 7 is approximately Rh70 and the maximum hardness of the sleeve portion 5*a* and of the inner portion 7*b* of the shank 7 is approximately Rh45. Of course the fact that the outer end portion 7*a* is harder than the remaining portions tends to prevent deformation of the outer end portion of the shank and thus aids in maintaining desired contact between the end 11 of the contact pin 4 and the side of end portion 7*a* of shank 7. Furthermore since the reduced inner portion 7*b* is relatively soft as compared to portion 7*a*, bending of portion 7*b* is facilitated. Of course bending of this portion tends to relieve the tendency of a force applied in the region 1*d* to cause a shift in position of the outer end portion 7*a* of shank 7 and deformation thereof. The fact that the sleeve portion 5*a* of the contact sleeve 5 is also relatively soft accommodates desired crimping or clamping action of the sleeve portion 5*a* about conductor 2 in desired manner.

Figure 3:
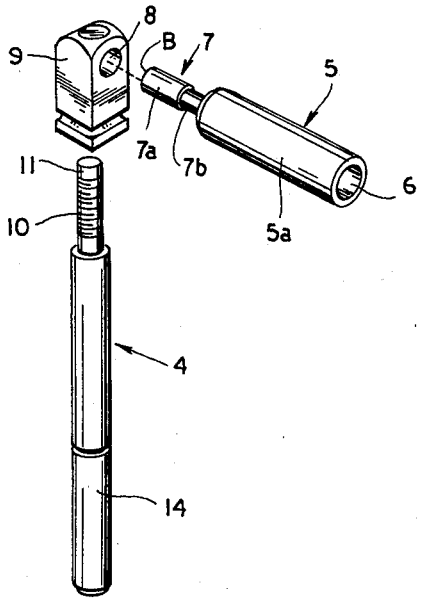
Figure 4:
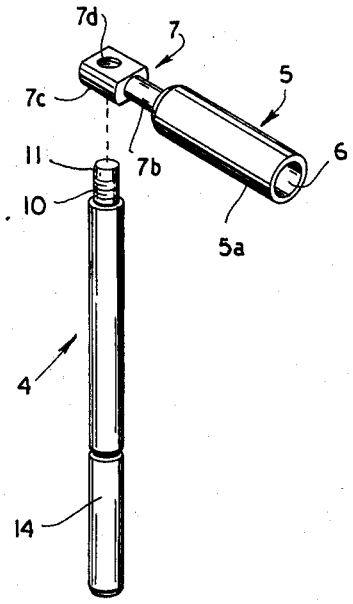
FIG. 4 is a view similar to FIG. 3 but which shows an alternative modified form of the invention.

FIG. 4 discloses an arrangement similar to FIG. 3 wherein the contact block 9 is eliminated and a threaded aperture 7*d* formed in the outer end portion 7*c* of the shank 7. Of course the threads of aperture 7*d* cooperate with the threads 10 of the contact pin to form an electric circuit therebetween. The contact sleeve 5 in the arrangement of FIG. 4 is formed in a manner similar to that used in forming the contact sleeve of FIG. 3. More specifically the outer end portion 7*c* is of a minimum hardness of Rh70 while the reduced diameter shank portion 7*b* and the sleeve portion 5*a* are of maximum hardness of approximately Rh45. Thus the outer end portion 7*c* and its threads 7*d* are not readily deformable but are relatively hard and thus maintain secure electric contact with the contact pin 4. The soft reduced diameter inner portion 7*b* of the shank 7 accommodates shifting of position of sleeve portion 5*a* relative to the contact pin 4 without tending substantially and undesirably to deform the outer end portion 7*c*. Furthermore the sleeve portion 5*a* is soft enough to be readily crimped or clamped about conductor 2 in the desired known manner.

While it is desirable for most applications of the invention to form the shank 7 in such manner that the outer end portion 7*a* is considerably harder than inner portion 7*b* of shank 7, it is within the contemplation of the invention to form the entire shank 7 in such manner that it is uniformly hard relative to the soft sleeve portion 5*a* of the contact sleeve.

The embodiments of the invention in which an exclusive property or privilege is claimed are defined as follows:

1. An electric elbow connector comprising an elongated contact sleeve having a hollow sleeve portion at one end and an integral shank at the other end, said shank having an outer end portion and an inner portion, said inner portion of said shank being of a substantially smaller transverse dimension than said outer portion whereby said inner portion of said shank is rendered more readily deformable than said outer end portion, an electric conductor having an end portion disposed within said sleeve portion of said contact sleeve and secured therein, and a contact pin in electric contact with said outer end portion of said shank.

2. An electric elbow according to claim 1 wherein a contact body having formed therein a pair of angularly related intersecting contact making passages in one of which the shank end of said contact sleeve is disposed and in the other of which an end of said contact pin is threadedly mounted in such manner that the end of said contact pin is in high pressure contact with the outer end portion of said shank end of said contact sleeve.

3. An electric elbow connector according to claim 1 wherein said outer end portion of said shank includes a transverse threaded aperture in which an end of said contact pin is threadedly mounted.

4. An electric elbow connector according to claim 1 wherein said contact sleeve is formed of aluminum and wherein said contact pin is formed of copper.

5. An electric elbow connector according to claim 1 wherein said contact sleeve is formed of substantially homogenous metal and wherein the hardness of said outer end portion of said shank is substantially greater than that of said inner portion of said shank and of said sleeve portion of said contact sleeve.

6. An electric elbow connector according to claim 5 wherein the minimum hardness of said outer end portion of said shank is approximately Rh70.

7. An electric elbow connector according to claim 5 wherein the maximum hardness of said inner portion of said shank and of said sleeve portion of said contact sleeve is approximately Rh45.

8. An electric elbow connector comprising an elongated contact sleeve having a hollow sleeve portion at one end and an integral shank at the other end, said shank having an outer end portion and an inner portion, said inner portion of said shank being of a substantially smaller transverse dimension than said outer end portion, and said contact sleeve being formed of substantially homogenous metal and the hardness of said outer end portion of said shank being substantially greater than that of said inner portion of said shank and of said sleeve portion of said contact sleeve.

9. A contact sleeve for an electric elbow connector, said contact sleeve comprising an elongated cylindrical structure formed of aluminum and having a hollow sleeve portion at one end and an integral coaxial shank at the other end, said shank having an outer end portion and an inner portion, said inner portion of said shank being of a substantially smaller diameter than said outer end portion whereby said inner portion of said shank is rendered more readily deformable than said outer end portion, the minimum hardness of said outer end portion of said shank being approximately Rh70 and the maximum hardness of said inner portion of said shank and of said sleeve portion being approximately Rh45.

10. An elongated contact sleeve formed of substantially homogeneous metal for use in an electric elbow connector, said contact sleeve comprising a hollow sleeve portion at one end and a shank at the other end, said shank having an outer end portion and an inner portion, the outer end portion being of considerably greater hardness than that of said sleeve portion and of said inner portion whereby said inner portion is rendered more readily deformable than said outer end portion.

11. A contact sleeve according to claim 10 wherein a contact body having a contact making passage therein is arranged so that at least a part of said outer end portion of said shank is received within said passage and wherein means are provided for engaging said outer end portion of said shank thereby to secure at least a part of said shank within said passage.

12. A contact sleeve according to claim 10 wherein said outer end portion of said shank includes a transverse threaded aperture for threadedly receiving a contact pin.

* * * * *